US007434664B2

(12) United States Patent
Helstrom

(10) Patent No.: US 7,434,664 B2
(45) Date of Patent: Oct. 14, 2008

(54) ELEVATOR BRAKE SYSTEM METHOD AND CONTROL

(75) Inventor: Bradley John Helstrom, McKinney, TX (US)

(73) Assignee: Kone Corporation, Helsinki (FI)

( * ) Notice: Subject to any disclaimer, the term of this patent is extended or adjusted under 35 U.S.C. 154(b) by 581 days.

(21) Appl. No.: 11/073,544

(22) Filed: Mar. 8, 2005

(65) Prior Publication Data

US 2006/0201752 A1 Sep. 14, 2006

(51) Int. Cl.
*B66B 13/14* (2006.01)

(52) U.S. Cl. ..... 187/314; 187/306; 187/391

(58) Field of Classification Search ..... 187/247, 187/313, 314, 290, 391–393, 277, 287, 306, 187/377–379
See application file for complete search history.

(56) References Cited

U.S. PATENT DOCUMENTS 3,613,835 A * 10/1971 Vizzotto ..... 187/288
3,961,688 A 6/1976 Maynard
4,133,413 A 1/1979 Watanabe
4,441,584 A 4/1984 Mitsui et al.
4,454,930 A 6/1984 Nomura et al.
4,982,815 A 1/1991 Arabori et al.
5,025,896 A * 6/1991 Arabori et al. ..... 187/292
5,228,364 A 7/1993 Casa
5,698,823 A 12/1997 Tanahashi
6,173,814 B1 1/2001 Herkel et al.
6,179,090 B1 1/2001 Casas
6,196,355 B1 3/2001 Fargo et al.
6,264,005 B1 7/2001 Kang et al.
6,269,910 B1 8/2001 Fargo et al.
6,364,066 B1 4/2002 Bolch et al.
6,374,953 B1 4/2002 Casas
6,405,834 B1 6/2002 Chida et al.
6,494,296 B2 * 12/2002 Lindegger et al. ..... 187/393
6,516,921 B1 2/2003 Wang
6,631,790 B2 10/2003 Mattlar et al.
6,966,409 B2 11/2005 Wang

* cited by examiner

*Primary Examiner*—Jonathan Salata
(74) *Attorney, Agent, or Firm*—Birch, Stewart, Kolasch & Birch, LLP

(57) ABSTRACT

A rescue braking system provides a smoother elevator car movement by mechanically lifting or applying the brake. The rescue braking system incrementally adjusts the force applied to the brake based on the speed and location of the elevator car. Therefore, it can effectively eliminate the jerky vibration and noises caused by the fully on-off brake systems and make the passengers feel more comfortable when the elevator car drifts to the nearest floor door.

25 Claims, 4 Drawing Sheets

ELEVATOR BRAKE SYSTEM METHOD AND CONTROL

BACKGROUND OF THE INVENTION

1. Field of the Invention

The present invention generally relates to a rescue braking system, and more particularly, to a rescue braking system for rescuing trapped elevator passenger by mechanically lifting or applying the brake with a brake release cable.

2. Description of the Background Art

The machine-roomless (MRL) elevator systems were introduced several years ago. MRL elevators use permanent magnets to boost the power of the motor. This reduces the size of the motor so that it is small enough to fit within the elevator hoistway rather than requiring a separate machine room. With the MRL elevator systems, the developers are able to utilize the full height of the building for floor space without having to sacrifice the top floor for a machine room. If a building is subject to height restrictions, an MRL elevator might allow the structure to meet the restriction by reducing the height needed for a new building. What's more, MRL systems allow greater flexibility in locating the elevators without structural considerations.

In the MRL elevator systems, the elevator brake is no longer easily accessible because there is no machine room. In other words, the conventional rescue systems which require accessing the brake in the machine room are no longer applicable. Therefore, rescue of passengers trapped in an MRL elevator system under an emergency circumstance, such as an electricity outage or control system failure, becomes an important issue.

Several elevator rescue systems have been proposed and implemented for rescuing trapped elevator passenger from the MRL elevators. One conventional system involves applying voltage to the motor coils of the brake. Such a system repeatedly energizes and de-energizes the brake coils to alternately release and apply the brake of the elevator car. FIG. 1 shows the speed of the elevator car during the operation of the conventional elevator rescue system, as shown in FIG. 1, when the elevator moves too fast, the elevator rescue system would apply voltage to the motor coils so that the brake is fully open. On the other hand, when the elevator moves too slowly, the rescue system would apply voltage to the motor coils so that the brake was fully off and the elevator car moves freely.

In other words, the brake in the conventional rescue system is always fully on or off, which causes a jerky vibration on the elevator car as the elevator car drifts to the nearest floor door. Such jerky vibration would make the trapped passengers uncomfortable and may cause some injury. Also, such a system is noisy.

Therefore, there is a need in the art for an elevator rescue system to make the elevator car drift smoothly to a desired floor.

SUMMARY OF THE INVENTION

The present invention fulfills the aforementioned need in the art by providing a rescue braking system to mechanically lift or apply the brake. The rescue braking system comprises a rescue brake controller and an enable device. The rescue brake controller comprises a battery, a brake release cable coupling to a brake (or a plurality of brakes) of an elevator motor, an actuator operatively coupled to the brake release cable and a motion control. The motion control is coupled to the actuator, the battery, control subsystems (system power, speed detector and door zone detector) and the enable device. The actuator operates a brake release cable to mechanically engage and disengage the brake. The rescue brake control in response to an enable signal causes the actuator to gradually move the brake release cable. The motion control controls the actuator to incrementally adjust a force applied to the brake.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 2A:
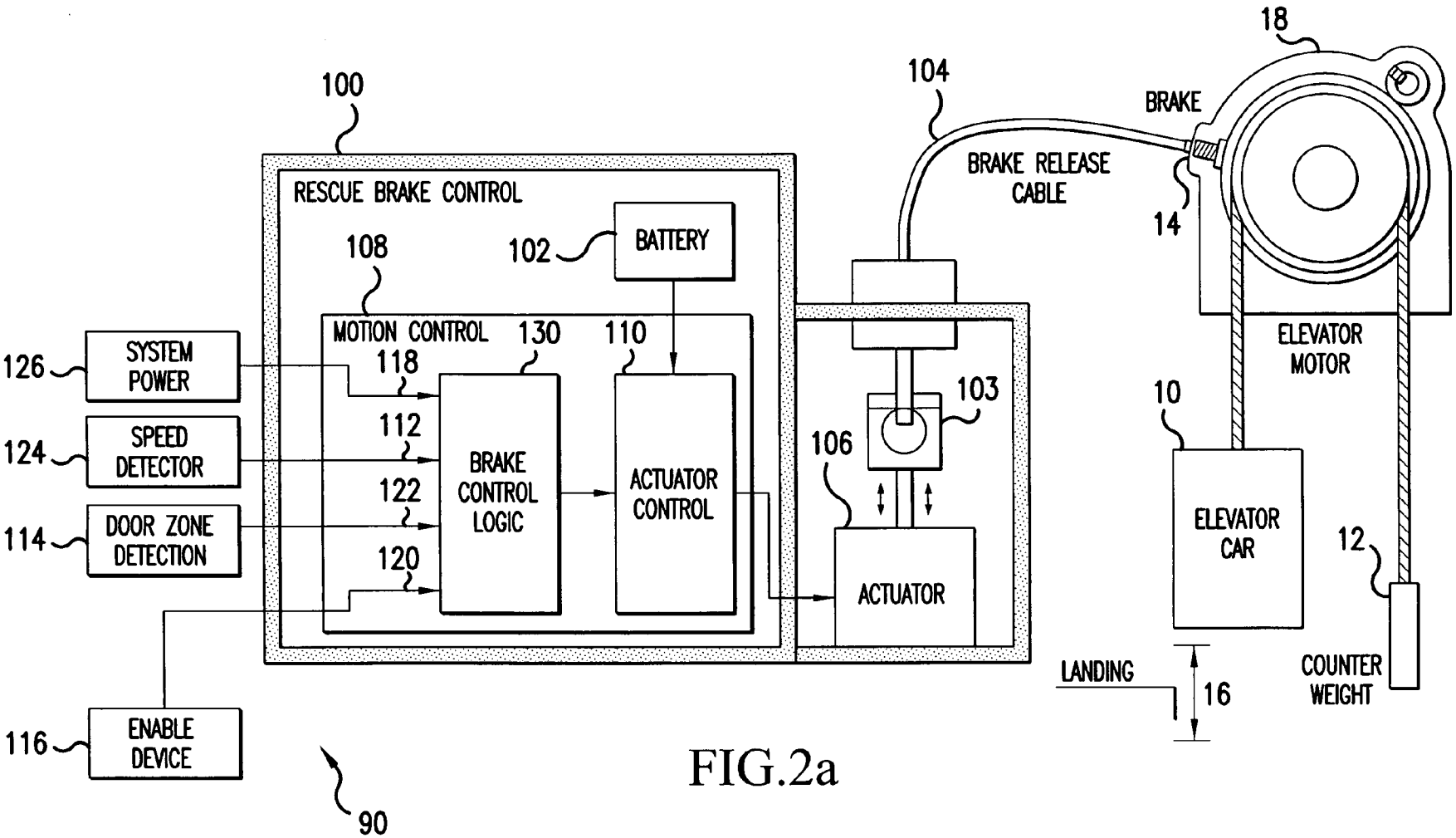
FIG. 2*a* is a schematic block diagram of the rescue braking system in accordance with a preferred embodiment of the present invention.

FIG. 2*a* is a schematic block diagram of the rescue braking system in accordance with a preferred embodiment of the present invention. The rescue braking system 90 comprises a rescue brake control 100 and an enable device 116. The rescue brake controller 100 includes a battery 102, a brake release cable coupling 103 to a brake release linkage coupled to a brake 14 of an elevator motor 18, an actuator 106, and a motion control 108. While a single brake 14 is shown, the present invention can control multiple brakes. Also, the brake release linkage could be a linkage arm or other mechanism or a brake release cable 104 as shown. Many variations for this linkage are contemplated even though the specification will refer to a cable 104. The actuator 106 can be a pneumatic or hydraulic actuator or a motorized linear actuator such as a screw or rack and pinion drive. Many different drives for the actuator 106 are possible.

The motion control 108 includes brake control logic 130 and actuator control 110. The battery 102 provides the power to operate the rescue braking system 100. In a preferred embodiment of the present invention, the battery 102 is a rechargeable battery. Of course, any other power sources could also be provided.

The actuator 106 is operatively coupled 103 to the brake release cable 104 and the motion control 108. The controller will be supplied with the coupling 103 so that the brake release cable 104, which is part of the elevator motor 18, can be connected thereto. The actuator 106 operates the brake release cable 104 to mechanically engage and disengage the brake 14. The actuator control 110 portion of the motion control 108 is coupled to the actuator 106 and to the battery 102. The brake control logic 130 of motion control 108 in response to an enable signal 120 from an enable device 116 causes the actuator 106 to move the brake release cable 104. The actuator control 110 of the motion control 108 controls the actuator 106 to incrementally adjust a force applied to the brake 14. The actuator control 110 can apply variable power to the actuator 106.

Figure 2B:
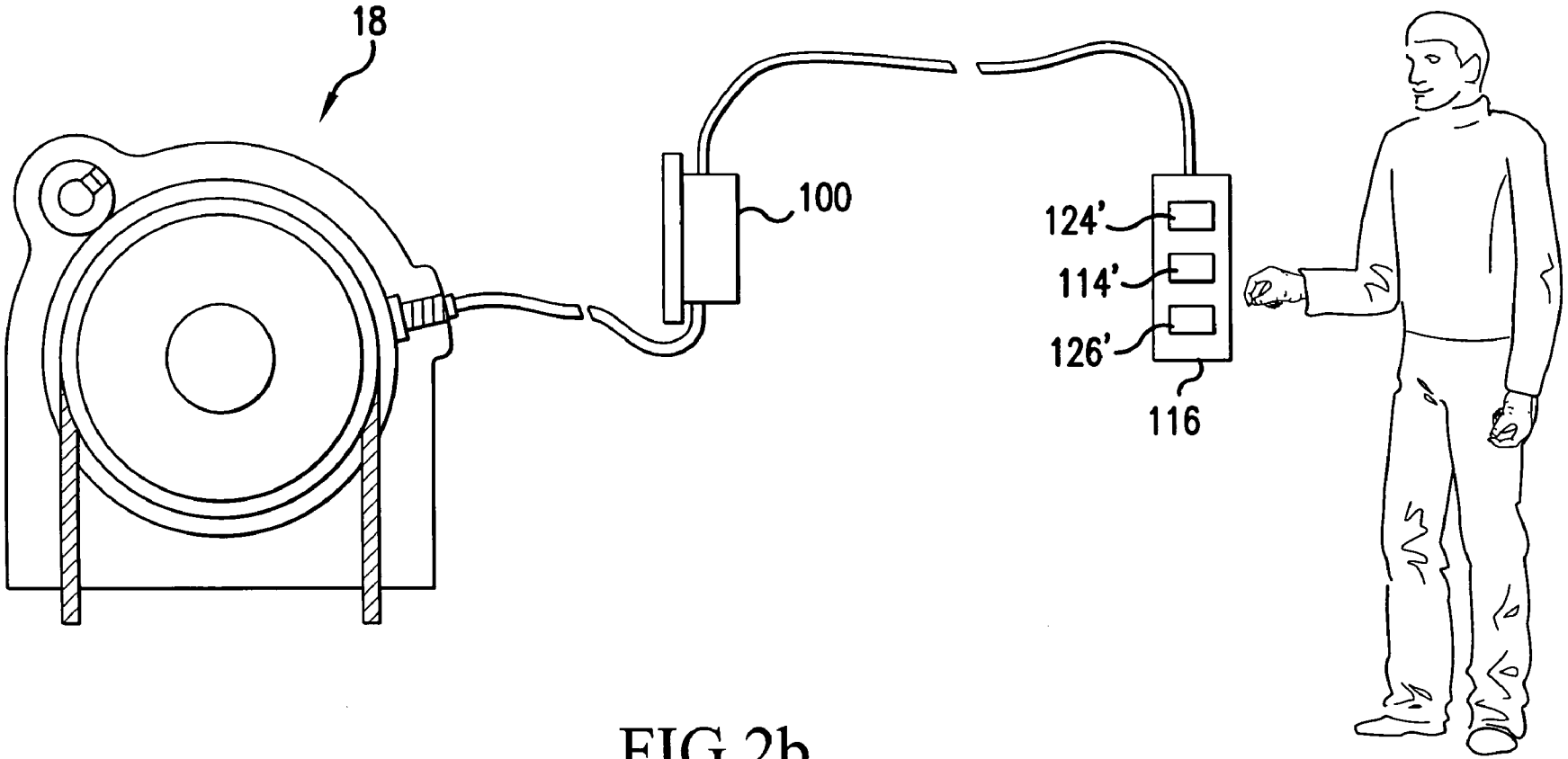
FIG. 2*b* is a schematic diagram showing a rescue brake control, an enable device and an elevator motor.

The rescue brake control 100 is located near the elevator motor 18 as shown in FIG. 2*b*. The enable device 116 can be located anywhere. For example, the rescue brake control 100 can be located on the wall near the elevator motor and the enable device 116 can be located at a distant control center, for example. The enable device 116 can also be located by the elevator controller to simplify the wiring between the brake controller 100 and the other control devices. The enable device 116 can be a secured key switch. Both a key switch and button can be used so that if the key switch sticks, the button will prevent the rescue system from lifting the brakes. However, it would be possible to use only a secured key switch alone.

In the embodiment shown in FIG. 2*a*, the motion control 108 includes an actuator control 110 and brake control logic 130 which responds to signals 118, 112, 122 and 120 from system power 126, a speed detector 124, a door zone detector 114 and the enable device 116, respectively. When an emergency situation such as an electricity outage occurs, the brake 14 drops due to the loss of voltage, stopping the elevator car 10 in order to prevent the elevator car 10 from suddenly falling. In a preferred embodiment of the present invention, the rescuer can enable the rescue braking system 100 via the enable device 116, such as an enable button or other input devices, remotely located from the elevator. For example, the enable device can be located on the wall outside the hoistway door of the elevator or any proper remote location as noted above. The enable device can also be located separately from the rest of the rescue brake control 100. For example, the rescue brake control 100 will be located by the elevator motor and the enable device can be located anywhere in the building.

The enable device 116 sends the enable signal 120 to the brake control logic 130 in response to the rescuer's input. After the rescuer enables the rescue braking system 100, the actuator control 110 in response to the enable signal 120 causes the actuator 106 to move the brake release cable 104. Therefore, the brake release cable 104 would mechanically lift the brake(s) 14 of the elevator car 10. After the brake(s) 14 is lifted, the elevator car 10 may move downward or upward depending on the total weight of the passengers and the elevator car 10 against the counterweight 12. The speed detector 124 detects the speed of the elevator car 10 while the elevator car 10 moves and sends the speed signal 112 to the brake control logic 130. In a preferred embodiment, the speed detector 124 is coupled to the sheave of the elevator motor 18 or to the elevator car 10 in order to determine the speed of the elevator car 10. The speed detector 124 can be a tachometer or an encoder or any other device capable of detecting car speed.

When the enable device 116 is located where viewing the hoist ropes is possible, it is not necessary for it to have a separate speed display 124, door zone indicator 114 or direction indicator. However, if the enable device and rescue brake control are placed at spaced locations, as shown in FIG. 2*b*, then a speed display 124', door zone indicator 114' or direction indicator 126' could also be provided for the enable device 116. The direction indicator 126' could also be a part of the speed display 124'.

To make the elevator car 10 move smoother without jerky vibration, the actuator control controls the actuator to incrementally adjust the force applied to the brake 14. In particular, to prevent the elevator car from moving too slowly, the motion control 110, in response to the speed of the elevator car 10 below a first predetermined speed, instructs the actuator control to increase the current to the actuator 106 to decrease the braking force. In a preferred embodiment of the present invention, the actuator control 110 controls the actuator current 106 to increase the force pulling the brake release cable 104.

Figure 3A:
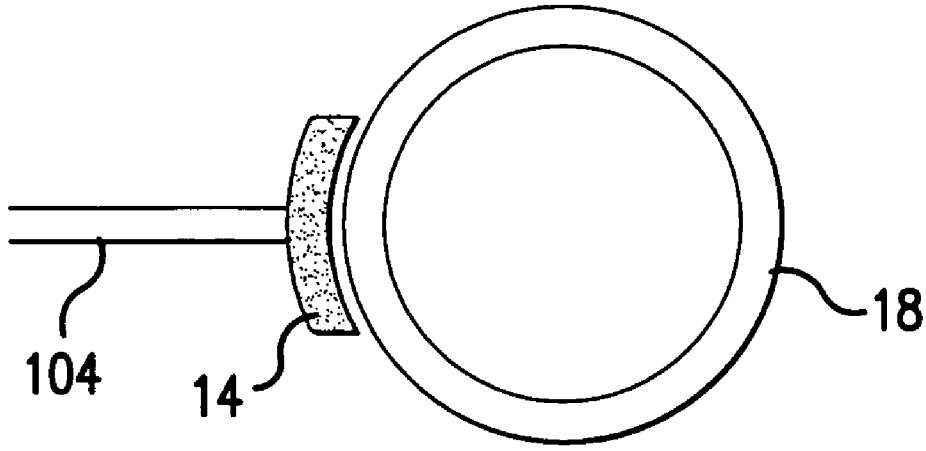
FIGS. 3*a-b* show the detailed operation of the brake in accordance with a preferred embodiment of the present invention.
Figure 3B:
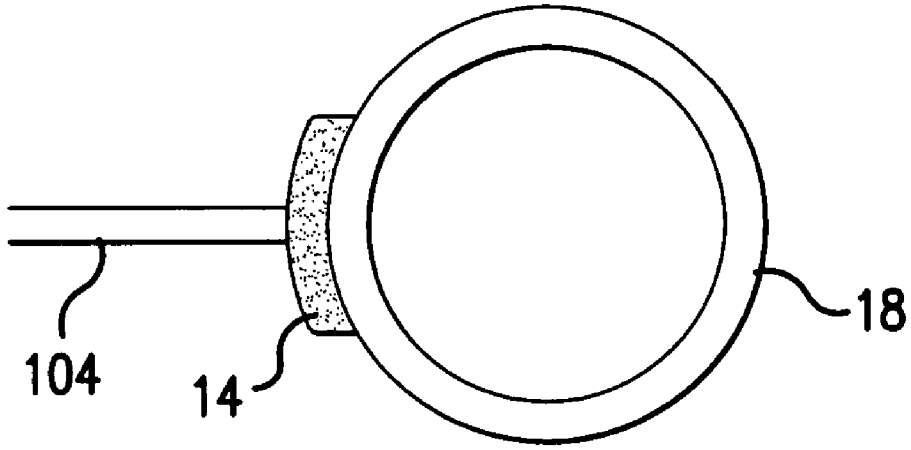

On the other hand, to prevent the elevator car from moving too fast, the motion control, in response to speed signal 112 of the elevator car 10 exceeding a second predetermined speed, instructs the actuator control to reduce the current to the actuator 106 to increase the force applied to the brake. In a preferred embodiment of the present invention, the actuator control 110 controls the current to the actuator 106 to decrease the force pulling the brake release cable 104. Therefore, the brake 14 would press the sheave 18 further, as shown in FIG. 3*b*, to increase the friction and thus reduce the speed. Of course, the brake 14 and brake release cable 104 can be set up so that pushing instead of pulling decreases the brake friction and thereby allows faster car movement.

Figure 1:
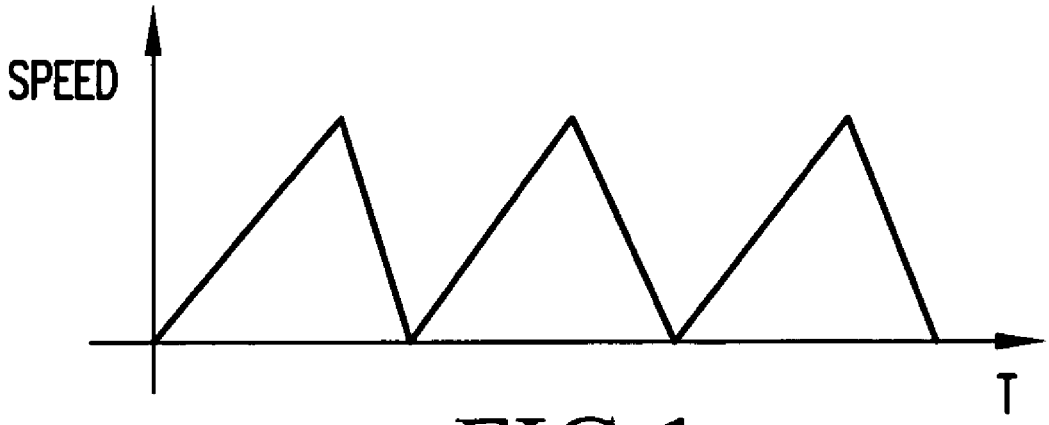
FIG.1 CONVENTIONAL ART
FIG. 1 shows the speed of the elevator car during the operation of the conventional elevator rescue system.
Figure 4:
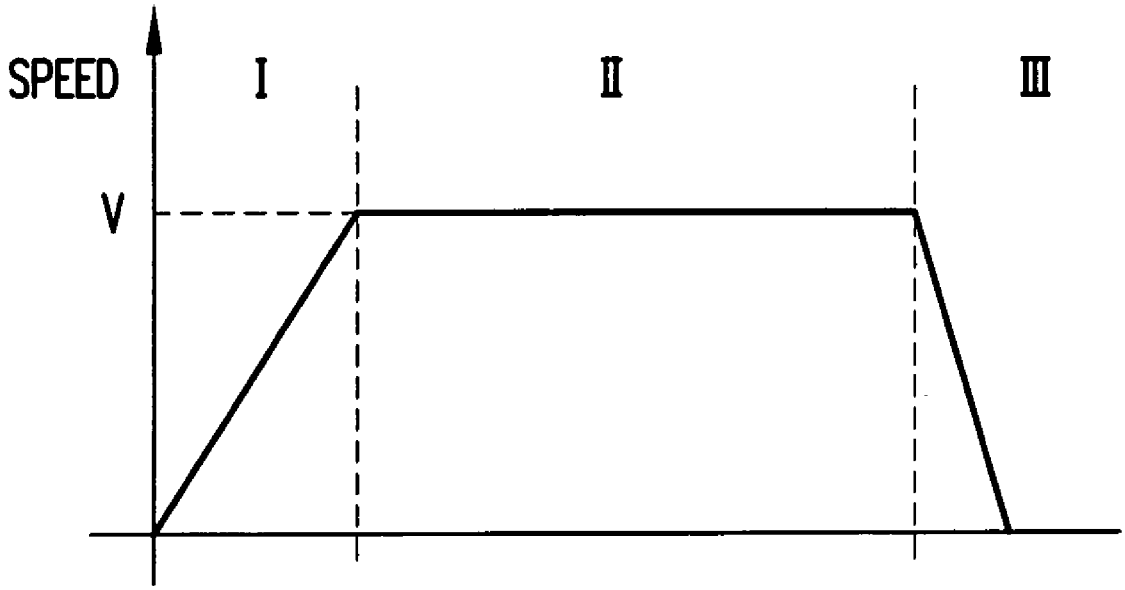
FIG. 4 shows the speed of the elevator car during the operation of the rescue braking system in accordance with an embodiment of the present invention.

In addition, the first predetermined speed can be equal to or different from the second predetermined speed. FIG. 4 shows the speed of the elevator car 10 during the operation of the rescue braking system in accordance with an embodiment of the present invention when the first predetermined speed is equal to the second predetermined speed. As shown in Part I of FIG. 4, when the speed of the elevator car 10 is below the predetermined speed V, the brake release cable 104 would further lift the brake away from the sheave 18, as shown in FIG. 3*a*, to reduce the friction and thus increase the speed until the speed of the elevator car 10 reaches the predetermined speed V. When the speed of the elevator car 10 reaches the predetermined speed V, the brake release cable 104 would keep the force for pulling the brake unchanged to keep a constant speed of the elevator car 10, as shown in Part II of FIG. 4.

Since the motion control 108 would incrementally adjust the force applied to the brake 14 based on the speed of the elevator car 10, rather than fully releasing or applying the brake 14 alternately, the elevator car 10 could move smoother than in the conventional system. It should be noted that the force applied to the brake 14 (or the brake release cable 104) can be adjusted manually by the rescuer via the motion control 108 or automatically by the motion control 108 itself. The rescuer can look at the speed detected by the speed detector 124 to adjust the force applied to the brake 14 (or the brake release cable 104).

The motion control 108 also controls the actuator 106 to incrementally adjust the force applied to the brake 14 based on the location of the elevator car 10. The door zone detector 114 detects the location reference to a door zone of the elevator car 10 and then sends a door zone signal 122 to the brake control logic 130 portion of the motion control 108. When the door zone signal 122 indicates the elevator car 10 reaches a location at a predetermined distance to the nearest floor door zone 16, the motion control 108 controls the actuator 106 to increase the braking force to slow the elevator to a stop. In a preferred embodiment of the present invention, the motion control 108 controls the actuator 106 to decrease the force pulling the brake release cable 104. Therefore, the brake 14 would press the sheave 18 further to increase the friction and thus reduce the speed to zero.

When the door zone signal 122 indicates the elevator reaches the floor door zone 16, the motion control 108 controls the actuator 106 to stop the elevator car in a controlled manner by operating the brake release cable 104. In a preferred embodiment of the present invention, the motion control 108 controls the actuator 106 to gradually reduce the applied force to the brake release cable 104. In other words, the brake 14 will gradually press the sheave 18 to stop the elevator car 10.

Part III of FIG. 4 shows the speed of the elevator car 10 during the operation of the rescue braking system in accordance with an embodiment of the present invention when the elevator approaches the floor door zone 16. As shown in Part III of FIG. 4, when the door zone signal 122 indicates the elevator car 10 reaches a location at a predetermined distance to the nearest floor door zone 16, the motion control 108 controls the actuator 106 to increase the force applied to the brake to reduce the speed until the elevator car comes to a complete stop.

It should be noted that the force applied to the brake 14 (or the brake release cable 104) can be adjusted manually by the rescuer via the motion control 108 or automatically by the motion control 108 itself. For example, the rescuer can look at the location detected by the door zone detector 112 and adjust the force applied to the brake 14 (or the brake release cable 104). Also, as noted above, this control of the brake 14 can also be done from a location remote from the elevator. This could be in a control room in the building in which the elevator controller is located or even from another building.

To prevent accidental lifting of the brake, the rescue braking control 100 would be disabled when the system power 126 is provided to the elevator system. The system power detect signal 118 detects the status of the system power 126 and notifies the motion control logic 130 portion of the motion control 108. When the system power 126 is on, the motion control 108 disables the actuator 106 so that no accidental lifting of the brake 14 would occur.

Accordingly, the present invention provides a smoother elevator rescue system by mechanically lifting or applying the brake. The rescue braking system of the present invention incrementally adjusts the force applied to the brake based on the speed and location of the elevator car. Therefore, the present invention can effectively eliminate the jerky vibration caused by the fully on-off brake and make the passengers feel more comfortable when the elevator car drifts to the nearest floor door. This invention also avoids the loud noises which occur in prior art rescues from the jerky elevator car movement. In addition, the present invention can be applied to any elevator system, including MRL elevator systems and machine-room elevator systems.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rescue braking system for an elevator comprising:

an enable device which issues an enable signal;

a rescue brake control, the rescue brake control having a brake release linkage coupled to an actuator, the actuator operating the brake release linkage to mechanically engage and disengage an elevator brake; and a motion control which is part of the rescue brake control, the motion control in response to at least the enable signal causes the actuator to incrementally adjust force applied by the brake release linkage, whereby an elevator car can be gradually moved.

2. The rescue braking system for an elevator as recited in claim 1, wherein the rescue brake control further includes input devices including at least one of a system power detector, speed detector and door zone detector which issues signals used by the motion controller to further adjust force applied by the brake release linkage.

3. The rescue braking system for an elevator as recited in claim 2, wherein the enable device is located apart from the rescue brake control and wherein the enable device has at least one of an elevator car speed display, a door zone display and a system power display.

4. The rescue braking system for an elevator as recited in claim 1, further comprising a battery for supplying power to the system.

5. The rescue braking system as recited in claim 1, wherein the motion control, in response to a speed of the elevator car below a first predetermined speed, controls the actuator to decrease the force applied by the brake, and the motion control, in response to the speed of the elevator car exceeding a second predetermined speed, controls the actuator to increase the force applied by the brake.

6. The rescue braking system as recited in claim 5, wherein the rescue brake control further comprises a speed detector, the motion control acquiring the speed of the elevator car from the speed detector.

7. The rescue braking system as recited in claim 1, wherein the rescue brake control further comprises a door zone detector, the door zone detector sending a door zone signal to a brake control logic of the motion control, the motion control, in response to the door zone signal, controlling the actuator to incrementally adjust force applied by the brake.

8. The rescue braking system as recited in claim 7, wherein when the door zone signal indicates the elevator car reaches a location at a predetermined distance to a floor door zone, the motion control controls the actuator to increase the braking force until the elevator car is stopped.

9. The rescue braking system as recited in claim 1, wherein the enable device is coupled to a brake control logic of the motion control, the enable device being remotely located from the elevator, the enable signal being transmitted to the motion control by the enable device.

10. The rescue braking system as recited in claim 1, wherein rescue brake control includes a system power detector and a brake control logic of the motion control, the brake control logic disables the actuator when a system power is detected.

11. A method for rescuing passengers trapped in an elevator car of an elevator, the elevator having a brake coupled to a brake release linkage, the method comprising the steps of:

receiving an enable signal;

moving the brake release linkage with a force provided by a battery, controlled by a motion control, in response to the enable signal, thereby mechanically lifting the brake;

monitoring a speed of the elevator car; and incrementally adjusting the force applied to the brake release linkage in response to the speed of the elevator car to thereby enable gradual movement of the elevator car.

12. The method for rescuing trapped elevator passengers as recited in claim 11, wherein the adjusting step comprises:

increasing the force applied to the brake release linkage in response to the speed of the elevator car below a first predetermined speed; and decreasing the force applied to the brake release linkage in response to the speed of the elevator car exceeding a second predetermined speed.

13. The method for rescuing trapped elevator passengers as recited in claim 11, further comprising incrementally adjusting the force applied to the brake release linkage in response to a door zone signal.

14. The method for rescuing trapped elevator passengers as recited in claim 13, wherein the step of incrementally adjusting the force applied to the brake release linkage in response to a door zone signal comprises:

decreasing the force applied to the brake release linkage to reduce the speed until elevator car is stopped in response to the door zone signal indicating the elevator car reaches a location at a predetermined distance to a floor door zone; and stopping applying the force to the brake release linkage when zero speed is reached at the door zone.

15. The method for rescuing trapped elevator passengers as recited in claim 11, wherein the receiving step comprises receiving the enable signal from an enable device remotely located from the elevator.

16. The method for rescuing trapped elevator passengers as recited in claim 11, wherein the monitoring step comprises acquiring the speed of the elevator car from a speed detector.

17. The method for rescuing trapped elevator passengers as recited in claim 11, further comprising:

providing system power; and stopping applying the force to the brake release linkage in response to the system power.

18. A rescue brake control for an elevator, comprising:

a motion control connected to an actuator which is operatively coupled to a brake release linkage, the actuator operating the brake release linkage to mechanically engage and disengage a brake of the elevator, the motion control comprising:

an actuator control for controlling current to the actuator, the actuator control being coupled to a battery; and brake control logic coupled to the actuator control, the brake control logic receives control signals and an enable signal to cause the actuator control to control current causing the actuator to move the brake release linkage, one of the control signals being a speed of the elevator car, the brake control logic in response to the speed of the elevator car signal instructs the actuator control to control current to the actuator to incrementally adjust force applied by the brake.

19. The rescue brake control as recited in claim 18, wherein the control signals further include system power and door zone detection.

20. The rescue brake control as recited in claim 18, wherein in response to the speed of the elevator car below a first predetermined speed, the motion control controls the actuator to decrease force applied by the brake, and the motion control, in response to the speed of the elevator car exceeding a second predetermined speed, controls the motor to increase force applied by the brake.

21. The rescue brake control as recited in claim 18, further comprising a door zone detector coupled to the motion control, the door zone detector sending a door zone signal to the brake control logic of the motion control, the motion control, in response to the door zone signal, controlling the actuator to incrementally adjust the force applied by the brake.

22. The rescue brake control as recited in claim 21, wherein when the door zone signal indicates the elevator car reaches a location at a predetermined distance to a floor door zone, the motion control controls the actuator to increase force applied by the brake gradually until the elevator car comes to a stop.

23. The rescue brake control of claim 18, further receiving the enable signal from the enable device, the enable device being remotely located from the rescue brake control, the enable signal being transmitted to the motion control by the enable device.

24. The rescue brake control as recited in claim 18, wherein a speed detector outputs a signal to the motion control to determine the speed of the elevator car.

25. The rescue brake control as recited in claim 18, wherein a system power signal is output to the motion control, the motion control disabling the actuator in response to existence of system power.

* * * * *